US008873216B2

(12) United States Patent
Ikeda et al.

(10) Patent No.: US 8,873,216 B2
(45) Date of Patent: Oct. 28, 2014

(54) PLASMA GENERATION DEVICE

(71) Applicant: IMAGINEERING, Inc., Kobe (JP)

(72) Inventors: Yuji Ikeda, Kobe (JP); Minoru Makita, Kobe (JP)

(73) Assignee: IMAGINEERING, Inc., Kyogo (JP)

( * ) Notice: Subject to any disclaimer, the term of this patent is extended or adjusted under 35 U.S.C. 154(b) by 0 days.

(21) Appl. No.: 13/735,441

(22) Filed: Jan. 7, 2013

(65) Prior Publication Data

US 2013/0119865 A1 May 16, 2013

Related U.S. Application Data

(63) Continuation of application No. PCT/JP2011/065252, filed on Jul. 4, 2011.

(30) Foreign Application Priority Data

Jul. 7, 2010 (JP) ..... 2010-155293

(51) Int. Cl.

| | |
|---|---|
| ***F23Q 3/00*** | (2006.01) |
| ***H05H 1/46*** | (2006.01) |
| ***F02P 23/04*** | (2006.01) |
| ***F02P 3/01*** | (2006.01) |
| ***H05H 1/50*** | (2006.01) |

(52) U.S. Cl.

CPC . *H05H 1/50* (2013.01); *H05H 1/46* (2013.01); *H05H 2001/466* (2013.01); *F02P 23/04* (2013.01); *F02P 3/01* (2013.01)

USPC ..... 361/247; 361/253

(58) Field of Classification Search

USPC ..... 361/247, 253, 255; 123/606, 637

See application file for complete search history.

(56) References Cited

U.S. PATENT DOCUMENTS

| | | | | |
|---|---|---|---|---|
| 4,392,082 | A * | 7/1983 | Harada | 315/55 |
| 5,361,737 | A * | 11/1994 | Smith et al. | 123/143 B |
| 2006/0048732 | A1 | 3/2006 | Schmidt et al. | |
| 2006/0057854 | A1 | 3/2006 | Setsuhara et al. | |
| 2008/0149083 | A1 | 6/2008 | Katoh et al. | |
| 2009/0188458 | A1 | 7/2009 | Visser et al. | |

(Continued)

FOREIGN PATENT DOCUMENTS

| | | | |
|---|---|---|---|
| JP | 2005-183396 | A | 7/2005 |
| JP | 2005-536684 | A | 12/2005 |

(Continued)

OTHER PUBLICATIONS

International Search Report for PCT/JP2011/065252, mailing date of Nov. 22, 2011.

*Primary Examiner* — Danny Nguyen

(74) *Attorney, Agent, or Firm* — Westerman, Hattori, Daniels & Adrian, LLP

(57) ABSTRACT

The plasma generation device 30 is provided with a high frequency generation device 37 that generates a high frequency wave, and a high frequency radiator 15 that radiates the high frequency wave outputted from the high frequency generation device 37 to a target space 10, and generates plasma by supplying energy of the high frequency wave to the target space 10. In the plasma generation device 30, the high frequency generation device 37 is provided with an oscillator 41 that oscillates a high frequency wave, and an amplifier 42 that amplifies and outputs the high frequency wave oscillated by the oscillator 41 to the high frequency radiator 15. In the high frequency generating device 37 the amplifier 42 alone is integrated with the high frequency radiator 15, from among the oscillator 41 and the amplifier 42.

8 Claims, 5 Drawing Sheets

(56) References Cited

U.S. PATENT DOCUMENTS

| | | | |
|---|---|---|---|
| 2009/0314239 | A1 | 12/2009 | Idogawa et al. |
| 2010/0196208 | A1 | 8/2010 | Makita et al. |

FOREIGN PATENT DOCUMENTS

| | | | |
|---|---|---|---|
| JP | 2008-175197 | A | 7/2008 |
| JP | 2009-036198 | A | 2/2009 |
| JP | 2009-085038 | A | 4/2009 |
| JP | 2009-537730 | A | 10/2009 |
| JP | 2009-281188 | A | 12/2009 |
| JP | 2010-001827 | A | 1/2010 |
| WO | 2004/064460 | A1 | 7/2004 |

* cited by examiner

PLASMA GENERATION DEVICE

TECHNICAL FIELD

The present invention relates to a plasma generation device that generates plasma by supplying a high frequency wave to a target space.

BACKGROUND ART

Conventionally, there is known a plasma generation device that generates plasma by supplying a high frequency wave to a target space. For example, Patent Document 1 discloses this type of a plasma generation device.

Patent Document 1 discloses a high frequency ignition plug that generates free plasma in air fuel mixture using an electric field structure protruding in a combustion chamber. A high frequency generator is used to generate a microwave, which is supplied to a high frequency ignition plug via an amplifier.

PATENT DOCUMENTS

Patent Document 1: Japanese Patent Application, Publication No. 2005-183396

DISCLOSURE OF THE INVENTION

Problems to be Solved by the Invention

In this type of a plasma generation device, electric power loss decreases as the length of a transmission line between a high frequency generation device and a high frequency radiator decreases. However, if a space in the vicinity of a location where the high frequency radiator is installed is limited, for example, in a case in which the high frequency radiator is installed on an engine, it is sometimes impossible to install the whole of the high frequency generation device in the vicinity of the high frequency radiator.

The present invention has been made in view of the above described problem, and it is an object of the present invention to provide a plasma generation device that generates plasma by supplying a high frequency wave to a target space, wherein electric power loss can be reduced in a transmission line between a high frequency generation device and a high frequency radiator, even in a case in which a space in the vicinity of a location where the high frequency radiator is installed is limited.

Means for Solving the Problems

In accordance with a first aspect of the present invention, there is provided a plasma generation device including a high frequency generation device that generates a high frequency wave, and a high frequency radiator that radiates the high frequency wave outputted from the high frequency generation device to a target space. The plasma generation device generates plasma by supplying energy of the high frequency wave to the target space from the high frequency radiator. In the plasma generation device, the high frequency generation device includes an oscillator that oscillates the high frequency wave, and an amplifier that amplifies the high frequency wave oscillated by the oscillator and outputs the high frequency wave thus amplified to the high frequency radiator. From among the oscillator and the amplifier, the amplifier alone is integrated with the high frequency radiator.

According to the first aspect of the present invention, from among the oscillator and the amplifier, the amplifier alone is integrated with the high frequency radiator. Since the amplifier and the high frequency radiator are integrated with each other, it is possible to shorten the transmission line between the amplifier and the high frequency radiator. In comparing a transmission line between the oscillator and the amplifier and the transmission line between the amplifier and the high frequency radiator, the latter is higher than the former in electric power loss per unit length since the latter transmits a larger amount of high frequency power than the former. According to the first aspect of the present invention, it is possible to shorten the transmission line relatively high in electric power loss by limiting parts of the high frequency generation device to be integrated with the high frequency radiator to the amplifier alone.

In accordance with a second aspect of the present invention, in addition to the feature of the first aspect of the present invention, the amplifier includes a plurality of stages of amplifying elements. From among the plurality of stages of amplifying elements, a downstream amplifying element is integrated with the high frequency radiator.

According to the second aspect of the present invention, in a case in which the amplifier alone, from among the oscillator and the amplifier, is integrated with the high frequency radiator, not the whole of the amplifier but apart of the amplifier is integrated with the high frequency radiator. From among the plurality of stages of amplifying elements, the downstream amplifying element alone is integrated with the high frequency radiator. Therefore, it is possible to shorten the transmission line between the amplifier and the high frequency radiator.

In accordance with a third aspect of the present invention, in addition to the feature of either the first or the second aspect of the present invention, the high frequency radiator is an ignition plug having a tip end side formed with a discharge gap and exposed to the target space.

In accordance with a fourth aspect of the present invention, in addition to the feature of the third aspect of the present invention, the ignition plug includes, separately from electrodes forming the discharge gap, an antenna for radiating high frequency waves to the target space.

In accordance with a fifth aspect of the present invention, in addition to the feature of either the third or the fourth aspect of the present invention, there is provided an ignition coil that outputs to the ignition plug a high voltage pulse for generating a discharge at the discharge gap. The amplifier is integrated with an ignition unit in which the ignition coil and the ignition plug are integrated.

According to the fifth aspect of the present invention, the amplifier is integrated with the ignition unit in which the ignition coil and the ignition plug (high frequency radiator) are integrated. In a case in which the amplifier includes the plurality of stages of amplifying elements, from among the plurality of stages of amplifying elements, the downstream amplifying element alone is integrated with the ignition unit.

In accordance with a sixth aspect of the present invention, in addition to the feature of the fifth aspect of the present invention, there is provided a mixer that is integrated with the ignition coil, mixes the high voltage pulse generated by the ignition coil and the high frequency wave amplified by the amplifier, and outputs it to the ignition plug. The amplifier is attached to the mixer, and integrated with the ignition unit via the mixer.

According to the sixth aspect of the present invention, the high voltage pulse and the amplified high frequency wave are mixed by the mixer and supplied to the ignition plug. The amplifier is integrated via the mixer with the high frequency radiator of the ignition unit.

In accordance with a seventh aspect of the present invention, in addition to the feature of any one of the first to sixth aspects of the present invention, a plurality of the high frequency radiators are provided, and a plurality of the amplifiers are provided corresponding to the high frequency radiators. The amplifiers are integrated with the respective high frequency radiators, and a high frequency switch is provided that switches a supply destination of the high frequency wave outputted from the oscillator, from among the plurality of amplifiers.

According to the seventh aspect of the present invention, the amplifiers are respectively integrated with the plurality of high frequency radiators. The high frequency wave outputted from the oscillator is supplied to one of the high frequency radiators, which is selected by the high frequency switch to be the supply destination of the high frequency wave. According to the seventh aspect of the present invention, even if the oscillators are less in number than the amplifiers and the high frequency radiators, it is possible to selectively radiate the high frequency wave from the plurality of high frequency radiators.

In accordance with an eighth aspect of the present invention, in addition to the feature of the second aspect of the present invention, there are provided a plurality of the high frequency radiators, a plurality of the downstream amplifying elements are provided corresponding to the high frequency radiators and the downstream amplifying elements are integrated with the respective high frequency radiators, and a high frequency switch is provided that switches a supply destination of the high frequency wave outputted from an upstream amplifying element from among the plurality of downstream amplifying elements.

According to the eighth aspect of the present invention, the downstream amplifying elements are respectively integrated with the plurality of high frequency radiators. The high frequency wave outputted from the upstream amplifying element is supplied through one of the downstream amplifying elements, which is selected by the high frequency switch as the supply destination of the high frequency wave, to the corresponding high frequency radiator. According to the eighth aspect of the present invention, even if the oscillators and the upstream amplifying elements are less in number than the high frequency radiators, it is possible to selectively radiate the high frequency wave from the plurality of high frequency radiators.

In accordance with a ninth aspect of the present invention, in addition to the feature of any one of the first to eighth aspects of the present invention, there is provided a power circuit that provides power for high frequency wave to the high frequency generation device. The oscillator is accommodated in the same casing as the power circuit.

According to the ninth aspect of the present invention, the oscillator is accommodated in the same casing as the power circuit.

In accordance with a tenth aspect of the present invention, in addition to the feature of any one of the first to ninth aspects of the present invention, the amplifier is integrated with the high frequency radiator in a state being accommodated in a metal casing for preventing the high frequency wave from leaking outside. Heat generated in the amplifier is released outside via the metal casing.

According to the tenth aspect of the present invention, the amplifier dissipates heat to the outside utilizing its own metal casing.

Effect of the Invention

According to the present invention, apart of the high frequency generation device to be integrated with the high frequency radiator is limited to the amplifier, thereby shortening the transmission line between the amplifier and the high frequency radiator, where electric power loss is relatively high. Since a part to be integrated with the high frequency radiator is limited to the amplifier, it is possible to avoid a unit, in which the high frequency generation device is integrated with the high frequency radiator, from increasing in size. Accordingly, even if an installation space in the vicinity of a space where the high frequency radiator is to be installed is small, it is possible to reduce electric power loss in the transmission line between the high frequency generation device and the high frequency radiator.

Furthermore, according to the second aspect of the present invention, a part to be integrated with the high frequency radiator is limited to the downstream amplifying element from among the amplifier of the high frequency generation device. Accordingly, it is further possible to avoid a unit, in which the amplifier is integrated with the high frequency radiator, from increasing in size.

Furthermore, according to the seventh and eighth aspects of the present invention, a high frequency switch is provided, thereby enabling to selectively emit the high frequency wave from the plurality of high frequency radiators, even if the oscillators are fewer in number than the high frequency radiators. Accordingly, it is possible to simplify the high frequency generation device in comparison to a case in which oscillators are provided individually in correspondence with the high frequency radiators.

Furthermore, according to the ninth aspect of the present invention, since the oscillator is accommodated in the same casing as the power circuit, it is possible to simplify the structure which accommodates the oscillator and the power circuit.

Furthermore, according to the tenth aspect of the present invention, since the amplifier dissipates heat to the outside utilizing the metal casing, which accommodates the amplifier itself, it is possible to simplify heat dissipation parts of the amplifier.

BEST MODE FOR CARRYING OUT THE INVENTION

In the following, a detailed description will be given of the embodiment of the present invention with reference to drawings. It should be noted that the following embodiment is a mere example that is essentially preferable, and is not intended to limit the scope of the present invention, applied field thereof, or application thereof.

The present embodiment is directed to a plasma generation device 30 according to the present invention. The plasma generation device 30 constitutes an ignition device that ignites air fuel mixture in a combustion chamber 10 of an internal combustion engine 20 by causing a spark discharge by an ignition plug 15 to absorb energy of an electromagnetic wave (microwave), thereby generating non-equilibrium plasma. The plasma generation device 30 is merely one example of the present invention. Firstly, the internal combustion engine 20 will be described hereinafter before the plasma generation device 30 is described in detail.

<Construction of Internal Combustion Engine>

Figure 1:
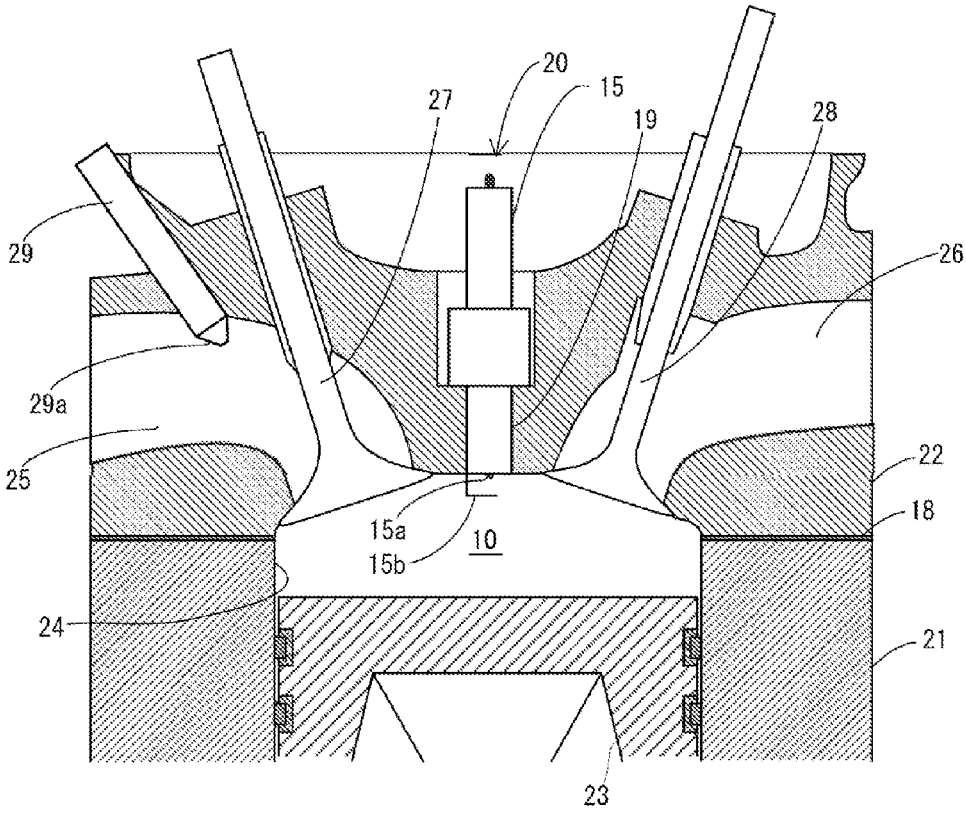
FIG. 1 is a longitudinal cross-section view of an internal combustion engine according to an embodiment.

The internal combustion engine 20 according to the present embodiment is constituted by a reciprocating engine, in which a piston 23 reciprocates. As shown in FIG. 1, the internal combustion engine 20 is provided with a cylinder block 21, a cylinder head 22, and pistons 23. The cylinder block 21 is formed with a plurality of cylinders 24 each having a circular cross section.

Inside of each cylinder 24, the piston 23 is slidably mounted. The piston 23 is connected to a crankshaft (not shown) via a conrod (connecting rod, not shown). The crankshaft is rotatably supported by the cylinder block 21. While the piston 23 reciprocates in each cylinder 24 in an axial direction of the cylinder 24, the conrod converts the reciprocal movement of the piston 23 into rotational movement of the crankshaft.

The cylinder head 22 is placed on the cylinder block 21, and a gasket 18 intervenes between the cylinder block 21 and the cylinder head 22. The cylinder head 22 partitions the combustion chamber 10 along with the cylinder 24 and the piston 23. The cylinder head 22 is provided for each cylinder 24 with one ignition plug 15. The ignition plug 15 is fixed to a plug mounting hole 19 formed on the cylinder head 22.

The cylinder head 22 is formed with one or more intake ports 25 and one or more exhaust ports 26 for each cylinder 24. The intake port 25 is provided with an intake valve 27 for opening and closing an opening part of the intake port 25, and an injector 29 (fuel injection device) that injects fuel. On the other hand, the exhaust port 26 is provided with an exhaust valve 28 for opening and closing an opening part of the exhaust port 26. According to the present embodiment, a nozzle 29*a* of the injector 29 is exposed to the intake port 25, and the fuel injected from the injector 29 is supplied to an air flowing in the intake port 25. Air fuel mixture, in which the fuel has been mixed with the air in advance, is introduced to the combustion chamber 10.

<Construction of Plasma Generation Device>

Figure 2:
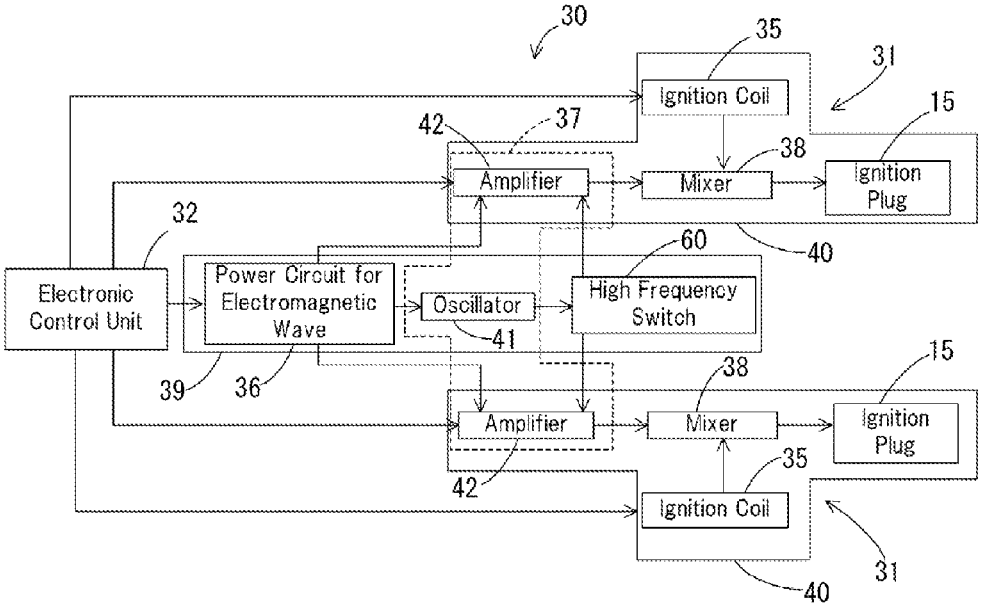
FIG. 2 is a block diagram of a plasma generation device according to the embodiment.

As shown in FIG. 2, the plasma generation device 30 is provided with a discharge device 31 that causes a discharge in the combustion chamber 10 (target space), an electromagnetic wave oscillation device 37 (high frequency generation device) that oscillates an electromagnetic wave, a power circuit for electromagnetic wave 36 that supplies power to the electromagnetic wave oscillation device 37, and an electromagnetic wave radiator 15 (high frequency radiator) that radiates the electromagnetic wave oscillated by the electromagnetic wave oscillation device 37 to the combustion chamber 10. The plasma generation device 30 generates non-equilibrium plasma in the combustion chamber 10 by causing the discharge device 31 to discharge, as well as radiating an electromagnetic wave using the electromagnetic wave oscillation device 37 and the electromagnetic wave radiator 15.

The plasma generation device 30 is connected to an electronic control unit 32 (sometimes referred to as "ECU") for controlling the internal combustion engine 20. The plasma generation device 30 is controlled by the electronic control unit 32.

The discharge device 31 is provided with an ignition plug 15 having a tip end side, which is formed with a discharge gap, being exposed to the combustion chamber 10, and an ignition coil 35 that generates a high voltage pulse to be applied to the ignition plug 15. The ignition plug 15 and the ignition coil 35 are integrated with each other to collectively constitute an ignition unit 40. The discharge device 31 is provided with ignition units 40 of the same number as that of the cylinders 24.

In the present embodiment, the plasma generation device 30 further includes a mixer 38. There are provided a plurality of the mixers 38 for the respective cylinders 24 of the internal combustion engine 20. Each mixer 38 receives the high voltage pulse outputted from the ignition coil 35 and the electromagnetic wave outputted from the electromagnetic wave oscillation device 37 at respectively different input terminals, and outputs the high voltage pulse and the electromagnetic wave from the same output terminal to the ignition plug 15. The mixer 38 is configured so as to be capable of mixing the high voltage pulse and the electromagnetic wave. In the present embodiment, the ignition plug 15 functions as the electromagnetic wave radiator.

The ignition coil 35 is connected to the electronic control unit 32 at an input terminal thereof, and connected to the mixer 38 at an output terminal thereof. The ignition coil 35 is connected to a vehicle battery (not shown) as well. Upon receiving a high-voltage-output signal from the electronic control unit 32, the ignition coil 35 outputs a high voltage pulse to the mixer 38.

The power circuit for electromagnetic wave 36 is connected to the electronic control unit 32 at an input terminal thereof, and connected to the electromagnetic wave oscillation device 37 at an output terminal thereof. The power circuit for electromagnetic wave 36 is connected to the vehicle battery as well. Upon receiving an electromagnetic-wave-output signal from the electronic control unit 32, the power circuit for electromagnetic wave 36, supplies power to the electromagnetic wave oscillation device 37.

The electromagnetic wave oscillation device 37 includes a semiconductor element (solid state element), and is configured to output an electromagnetic wave (microwave) of 2.45 GHz, for example. The electromagnetic wave oscillation device 37 is provided with an oscillator 41 that oscillates the electromagnetic wave, and an amplifier 42 that amplifies the electromagnetic wave oscillated by the oscillator 41 and outputs the high frequency wave thus oscillated to the ignition plug 15 (electromagnetic wave radiator). While the electromagnetic wave oscillation device 37 is provided with one single oscillator 41, the electromagnetic wave oscillation device 37 is provided with a plurality of the amplifiers 42 for respective ignition plugs 15 as well. The amplifiers 42 are integrated with the respective corresponding ignition plugs 15. The plasma generation device 30 is provided with a high frequency switch 60 that switches from one amplifier 42 to another amplifier 42, to which the electromagnetic wave outputted from the oscillator 41 is supplied.

The oscillator 41 is provided with an oscillating element (such as a field effect transistor) configured by a semiconductor element. The oscillator 41 is accommodated in the same casing 39 as that of the power circuit for electromagnetic wave 36. The oscillator 41 is connected to the power circuit for electromagnetic wave 36 at an input terminal thereof, and connected to the high frequency switch 60 at an output terminal thereof via a coaxial cable. Upon receiving power from the power circuit for electromagnetic wave 36, the oscillator 41 outputs an electromagnetic wave of low power to the high frequency switch 60. The high frequency switch 60 outputs the electromagnetic wave received from the oscillator 41 to one of the amplifiers 42 selected from among the plurality of amplifiers 42.

The amplifier 42 includes an amplifying element 43 (such as a field effect transistor) configured by a semiconductor element. The amplifying element 43 is attached to a circuit board 44. The amplifying element 43 includes a wide band-gap semiconductor element such as silicone carbide, gallium nitride, and/or the like. The amplifier 42 is connected to the power circuit for electromagnetic wave 36 and the high frequency switch 60 at respective input terminals thereof, and connected to the mixer 38 at an output terminal thereof. The amplifier 42 is further connected to the electronic control unit 32. The amplifier 42, which have been switched to under control of the electronic control unit 32, amplifies the electromagnetic wave inputted from the high frequency switch 60 and outputs a large current of the electromagnetic wave to the mixer 38.

In each ignition unit 40, the amplifier 42 is attached to the mixer 38, and integrated with the ignition coil 35 via the mixer 38. The amplifier 42 is also integrated with the ignition plug 15 via the mixer 38.

The mixer 38 is configured so as to be capable of mixing the high voltage pulse and the electromagnetic wave. The mixer 38 is connected to a central electrode 15*a* of the ignition plug 15 at an output terminal thereof. The high voltage pulse outputted from the ignition coil 35 and the electromagnetic wave amplified by the amplifier 42 are supplied to the ignition plug 15.

Figure 3:
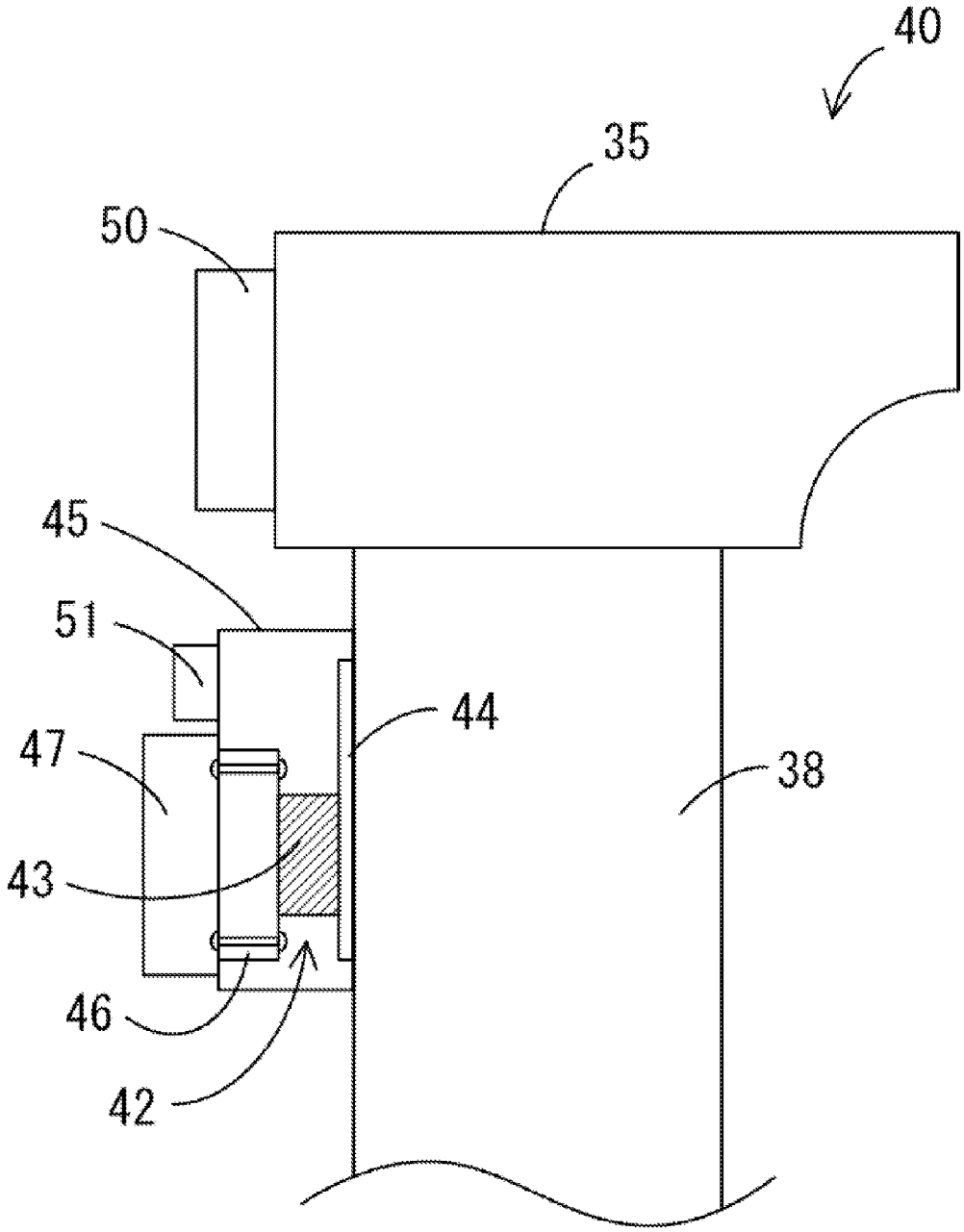
FIG. 3 is a schematic configuration diagram of a principal part of an ignition unit according to the embodiment.

As shown in FIGS. 2 and 3, each ignition unit 40 is a unit, in which the ignition coil 35, the ignition plug 15, the mixer 38, and the amplifier 42 are integrated. In each ignition unit 40, the mixer 38 is formed in a cylindrical shape. The mixer 38 is integrated with the ignition coil 35 at one end thereof, and integrated with the ignition plug 15 at the other end thereof.

In each ignition unit 40, an input terminal 50 of the ignition coil 35 and an input terminal 51 of the amplifier 42 are attached on the same side of the ignition unit 40. Inside of each ignition unit 40, the output terminal of the ignition coil 35 is connected to a first input terminal of the mixer 38, and the output terminal of the amplifier 42 is connected to a second input terminal of the mixer 38.

The output terminal of the mixer 38 is attached to the other end of the mixer 38. Each ignition unit 40 fits in a plug mounting hole 19 on a side of the output terminal of the mixer 38 in a state such that the output terminal of the mixer 38 is connected to the central electrode 15*a* of the ignition plug 15.

In the ignition unit 40, the amplifier 42 is integrated on an outer peripheral surface of the mixer 38. The amplifier 42 is accommodated in a metal casing 45 of a box shape that is fixed to the outer peripheral surface of the mixer 38 via a circuit board 44. The metal casing 45 prevents the electromagnetic wave amplified by the amplifier 42 from leaking. A first cooling member 46, which is made of metal and abutting the amplifying element 43, is attached to the metal casing 45. The first cooling member 46 abuts the metal casing 45. Heat generated in the amplifying element 43 is transferred to the metal casing 45 via the first cooling member 46, and released in the air in contact with the metal casing 45. The amplifier 42 dissipates heat to the outside utilizing the metal casing 45. Furthermore, a second cooling member 47 adapted to increase the amount of heat transfer of the heat, which is transferred from the amplifier 42, is attached to the metal casing 45.

<Operation of Plasma Generation Device>

The operation of the plasma generation device 30 and the electronic control unit 32 will be described hereinafter in association with the operation of the internal combustion engine 20. The internal combustion engine 20 performs plasma ignition operation of generating plasma in each cylinder 24 by means of the plasma generation device 30.

In the internal combustion engine 20 during the plasma ignition operation, the intake valve 27 is opened immediately before the piston 23 reaches the top dead center, and the intake stroke starts. Immediately after the piston 23 passes the top dead center, the exhaust valve 28 is closed, and the exhaust stroke ends. Immediately after the exhaust stroke ends, the electronic control unit 32 outputs an injection signal to the injector 29 to cause the injector 29 to inject fuel.

Immediately after the piston 23 passes the bottom dead center, the intake valve 27 is closed, and the intake stroke ends. After the intake stroke ends, a compression stroke of compressing the air fuel mixture in the combustion chamber 10 starts. During the compression stroke, immediately before the piston 23 reaches the top dead center, the electronic control unit 32 outputs a high-voltage-output signal to the ignition coil 35. As a result thereof, a high voltage pulse that has been boosted in the ignition coil 35 is outputted to the mixer 38.

Also, during the compression stroke, immediately before the piston 23 reaches the top dead center, the electronic control unit 32 outputs an electromagnetic-wave-output signal to the power circuit for electromagnetic wave 36. The electronic control unit 32 outputs the electromagnetic-wave-output signal before the high voltage pulse is outputted from the ignition coil 35. As a result thereof, power is supplied from the power circuit for electromagnetic wave 36 to the oscillator 41, and the oscillator 41 outputs an electromagnetic wave.

Furthermore, the electronic control unit 32 outputs a switch signal to the high frequency switch 60, thereby setting the supply destination of the electromagnetic wave, from among the plurality of amplifiers 42, to the amplifier 42 of the ignition unit 40 having the ignition coil 35, which receives the high-voltage-output signal, and outputs a control signal to the amplifier 42 thus set, thereby switching the amplifier 42. As a result thereof, the amplifier 42 amplifies the electromagnetic wave outputted from the oscillator 41, and outputs the amplified electromagnetic wave to the mixer 38. The mixer 38 is inputted with the high voltage pulse from the ignition coil 35 and the electromagnetic wave from the amplifier 42, and supplies the high voltage pulse and the electromagnetic wave to the central electrode 15*a* of the ignition plug 15.

As a result thereof, a spark discharge occurs due to the high voltage pulse at a discharge gap between the central electrode 15*a* and a ground electrode 15*b* of the ignition plug 15, and small scale plasma is generated. The small scale plasma is irradiated with an electromagnetic wave from the central electrode 15*a* of the ignition plug 15. The small scale plasma absorbs the energy of the electromagnetic wave and expands. In the combustion chamber 10, the expanded plasma causes volume ignition of the air fuel mixture, and combustion of the air fuel mixture starts. The electromagnetic wave is radiated from before and until after the spark discharge.

After the combustion of the air fuel mixture starts, the piston 23 is moved toward the bottom dead center by the expansion force of the combustion of the air fuel mixture. Before the piston 23 reaches the bottom dead center, the exhaust valve 28 is opened, and the exhaust stroke starts. As described above, the exhaust stroke ends immediately after the intake stroke starts.

In the present embodiment, the amplifier 42 of the ignition unit 40 attached to the cylinder 24, in which the piston 23 is immediately before reaching the top dead center in the compression stroke, is selected as the amplifier 42, which amplifies the electromagnetic wave. Subsequently, the electromagnetic wave amplified by the selected amplifier 42 is radiated to the combustion chamber 10 from the central electrode 15*a* of the ignition plug 15 of the ignition unit 40 to which the selected amplifier 42 belongs.

<Effect of Embodiment>

According to the present embodiment, in the electromagnetic wave oscillation device 37, a part to be integrated with the ignition plug 15 is limited to the amplifier 42, thereby shortening the transmission line between the amplifier 42 and the ignition plug 15, where electric power loss is relatively high. Since a part to be integrated with the ignition plug 15 is limited to the amplifier 42, it is possible to avoid the ignition unit 40 from increasing in size. Accordingly, even if an installation space for the ignition unit 40 is small, it is possible to reduce electric power loss in the transmission line between the electromagnetic wave oscillation device 37 and the ignition plug 15.

Furthermore, according to the present embodiment, since the semiconductor element that is small in comparison to a magnetron is employed as the electromagnetic wave oscillation device 37, it is possible to downsize the plasma generation device 30.

Furthermore, according to the present embodiment, the high frequency switch 60 is provided, thereby enabling to selectively emit the microwave from the plurality of ignition plugs 15, even if the oscillators 41 are fewer in number than the ignition plugs 15. Accordingly, it is possible to simplify the electromagnetic wave oscillation device 37 compared to a case in which as many oscillators 41 are provided as the ignition plugs 15.

Furthermore, according to the present embodiment, since the oscillator 41 is accommodated in the same casing 39 as the power circuit for electromagnetic wave 36, it is possible to simplify a construction that accommodates the oscillator 41 and the power circuit for electromagnetic wave 36.

Furthermore, according to the present embodiment, since the amplifier 42 dissipates heat to the outside utilizing the metal casing 45 that accommodate the amplifier 42 itself, it is possible to simplify heat dissipation parts of the amplifier 42.

Other Embodiments

The above described embodiment may also be configured as follows.

Figure 4:
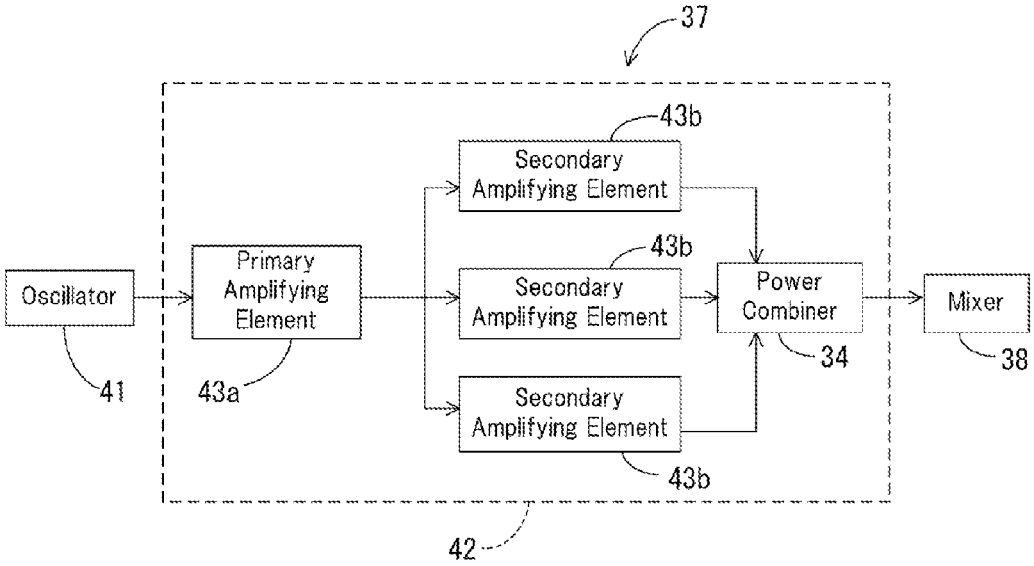
FIG. 4 is a block diagram of an electromagnetic wave oscillation device according to other embodiments.
Figure 5:
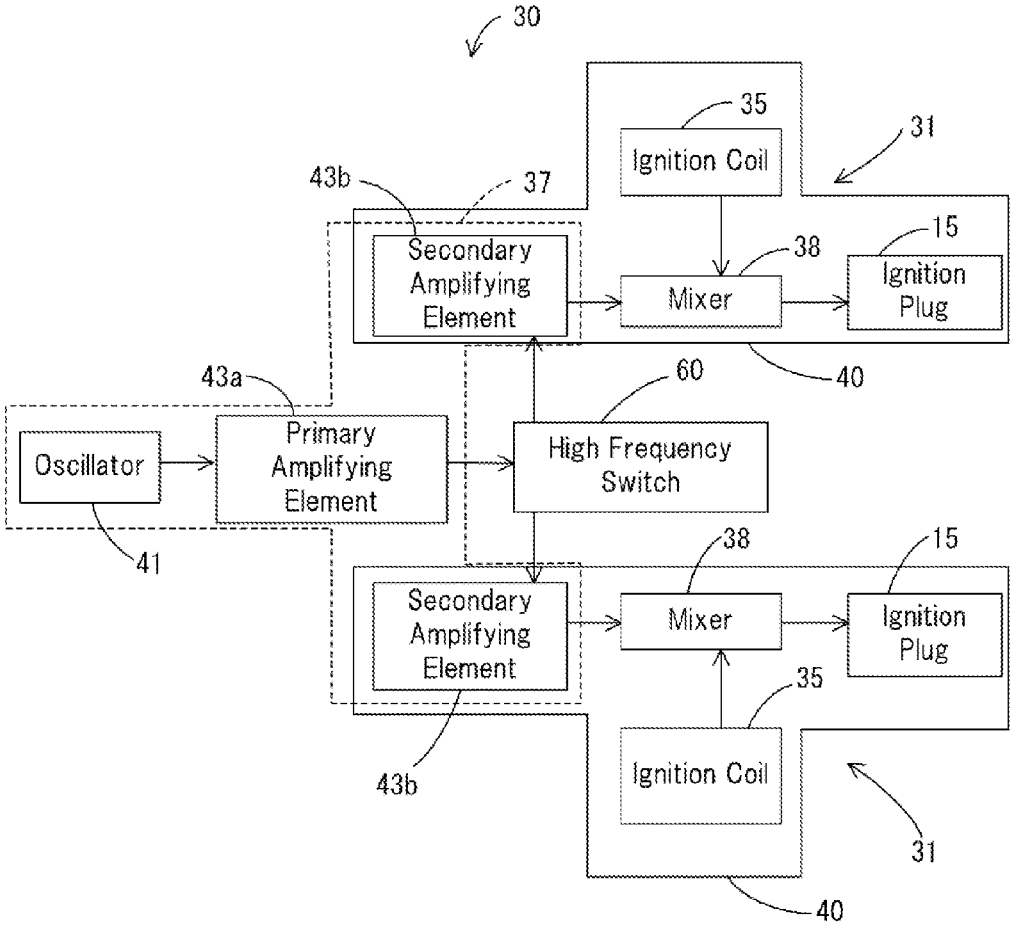
FIG. 5 is a block diagram of another electromagnetic wave oscillation device according to other embodiments.

In the embodiment described above, the amplifier 42 may include a plurality of stages of amplifying elements 43*a* and 43*b*. For example, the amplifier 42 includes a primary amplifying element 43*a* that amplifies the electromagnetic wave inputted from the oscillator 41, and a secondary amplifying element 43*b* that amplifies the electromagnetic wave outputted from the primary amplifying element 43*a*. In this case, as shown in FIG. 4, for each primary amplifying element 43*a*, a plurality of the secondary amplifying elements 43*b* are installed in parallel connection, and the electromagnetic wave amplified by the respective secondary amplifying elements 43*b* are combined by a power combiner 34. The amplifier 42 may be entirely integrated with the ignition plug 15. Only the secondary amplifying element 43*b* of downstream stage may be integrated with the ignition plug 15. In the latter case, the high frequency switch 60 shown in FIG. 5 switches the supply destination of the electromagnetic wave outputted from the primary amplifying element 43*a* from among the plurality of secondary amplifying elements 43*b*. In a case in which the amplifier 42 includes more than two stages of amplifying elements 43, downstream stages of amplifying elements 43 to be integrated with the ignition plug 15 may be more than one in number.

Furthermore, in the embodiment described above, the amplifying element 43 may dissipate heat in cooling water for cooling the internal combustion engine 20. For example, a metal plate extending from a flowing path of the cooling water of the internal combustion engine 20 may abut the metal casing 45.

Furthermore, in the embodiment described above, application of the high voltage pulse and radiation of the electromagnetic wave may take place at different locations. In this case, an antenna is provided apart from the central electrode 15*a* in the ignition plug 15. The mixer 38 is not necessary. The ignition coil 35 is directly connected to the central electrode 15*a* of the ignition plug 15, and the amplifier 42 is directly connected to the antenna. The antenna is integrated with the ignition plug 15 in such a manner as to penetrate through an insulator of the ignition plug 15. Also, the antenna may be attached to the cylinder head 22 separately from the ignition plug 15.

INDUSTRIAL APPLICABILITY

The present invention is useful in relation to a plasma generation device that generates plasma by supplying a high frequency wave to a target space.

EXPLANATION OF REFERENCE NUMERALS

15 Ignition Plug (Electromagnetic Wave Radiator)
30 Plasma Generation Device
31 Discharge Device
35 Ignition Coil
36 Power Circuit for Electromagnetic Wave
37 Electromagnetic Wave Oscillation Device
38 Mixer
40 Ignition Unit
41 Oscillator
42 Amplifier

What is claimed is:

1. A plasma generation device, comprising:

a high frequency generation device that generates a high frequency wave; and a high frequency radiator that radiates the high frequency wave outputted from the high frequency generation device to a target space, plasma being generated by supplying energy of the high frequency wave to the target space from the high frequency radiator, wherein the high frequency generation device includes an oscillator that oscillates the high frequency wave, and an amplifier that amplifies the high frequency wave oscillated by the oscillator and outputs the high frequency wave thus amplified to the high frequency radiator, and from among the oscillator and the amplifier, the amplifier alone is integrated with the high frequency radiator, wherein the amplifier includes a plurality of stages of amplifying elements, and from among the plurality of stages of amplifying elements, a downstream amplifying element is integrated with the high frequency radiator.

2. A plasma generation device, comprising:

a high frequency generation device that generates a high frequency wave; and a high frequency radiator that radiates the high frequency wave outputted from the high frequency generation device to a target space, plasma being generated by supplying energy of the high frequency wave to the target space from the high frequency radiator, wherein the high frequency generation device includes an oscillator that oscillates the high frequency wave, and an amplifier that amplifies the high frequency wave oscillated by the oscillator and outputs the high frequency wave thus amplified to the high frequency radiator, and from among the oscillator and the amplifier, the amplifier alone is integrated with the high frequency radiator, wherein the high frequency radiator is an ignition plug having tip end side formed with a discharge gap and exposed to the target space, wherein an ignition coil is provided that outputs a high voltage pulse for generating a discharge at the discharge gap to the ignition plug, and the amplifier is integrated with an ignition unit in which the ignition coil and the ignition plug are integrated.

3. The plasma generation device according to claim 2, comprising a mixer that is integrated with the ignition coil, mixes the high voltage pulse generated by the ignition coil and the high frequency wave amplified by the amplifier, and outputs it to the ignition plug, wherein the amplifier is attached to the mixer, and integrated with the ignition unit via the mixer.

4. A plasma generation device, comprising:

a high frequency generation device that generates a high frequency wave; and a high frequency radiator that radiates the high frequency wave outputted from the high frequency generation device to a target space, plasma being generated by supplying energy of the high frequency wave to the target space from the high frequency radiator, wherein the high frequency generation device includes an oscillator that oscillates the high frequency wave, and an amplifier that amplifies the high frequency wave oscillated by the oscillator and outputs the high frequency wave thus amplified to the high frequency radiator, and from among the oscillator and the amplifier, the amplifier alone is integrated with the high frequency radiator, the plasma generation device further comprising:

a plurality of the high frequency radiators, wherein a plurality of the amplifiers are provided corresponding to the high frequency radiators, and are integrated with the respective corresponding high frequency radiators; and a high frequency switch that switches a supply destination of the high frequency wave outputted from the oscillator from among the plurality of amplifiers.

5. The plasma generation device according to claim 1, comprising:

a plurality of the high frequency radiators wherein a plurality of the downstream amplifying elements are provided corresponding to the high frequency radiators and the downstream amplifying elements are integrated with the respective high frequency radiators; and a high frequency switch that switches a supply destination of the high frequency wave outputted from an upstream amplifying element, from among the plurality of downstream amplifying elements.

6. A plasma generation device, comprising:

a high frequency generation device that generates a high frequency wave; and a high frequency radiator that radiates the high frequency wave outputted from the high frequency generation device to a target space, plasma being generated by supplying energy of the high frequency wave to the target space from the high frequency radiator, wherein the high frequency generation device includes an oscillator that oscillates the high frequency wave, and an amplifier that amplifies the high frequency wave oscillated by the oscillator and outputs the high frequency wave thus amplified to the high frequency radiator, and from among the oscillator and the amplifier, the amplifier alone is integrated with the high frequency radiator, the plasma generation device further comprising a power circuit that provides power for high frequency wave to the high frequency generation device, wherein the oscillator is accommodated in the same casing as the power circuit.

7. A plasma generation device, comprising:

a high frequency generation device that generates a high frequency wave; and a high frequency radiator that radiates the high frequency wave outputted from the high frequency generation device to a target space, plasma being generated by supplying energy of the high frequency wave to the target space from the high frequency radiator, wherein the high frequency generation device includes an oscillator that oscillates the high frequency wave, and an amplifier that amplifies the high frequency wave oscillated by the oscillator and outputs the high frequency wave thus amplified to the high frequency radiator, and from among the oscillator and the amplifier, the amplifier alone is integrated with the high frequency radiator, wherein the amplifier is integrated with the high frequency radiator in a state being accommodated in a metal casing for preventing the high frequency wave from leaking outside, and heat generated in the amplifier is released to the outside via the metal casing.

8. The plasma generation device according to claim 2, wherein the ignition plug includes, separately from electrodes forming the discharge gap, an antenna for radiating high frequency waves to the target space.

* * * * *